US007329193B2

(12) United States Patent
Plank, Jr.

(10) Patent No.: US 7,329,193 B2
(45) Date of Patent: Feb. 12, 2008

(54) ELECTRONIC GOLF SWING ANALYZING SYSTEM

(76) Inventor: Richard G. Plank, Jr., 12224 Marine View Dr. SW., Seattle, WA (US) 98146

( * ) Notice: Subject to any disclaimer, the term of this patent is extended or adjusted under 35 U.S.C. 154(b) by 659 days.

(21) Appl. No.: 10/625,800

(22) Filed: Jul. 22, 2003

(65) Prior Publication Data

US 2004/0127304 A1 Jul. 1, 2004

Related U.S. Application Data

(60) Provisional application No. 60/398,041, filed on Jul. 23, 2002.

(51) Int. Cl.
*A63B 69/36* (2006.01)

(52) U.S. Cl. ..... 473/221

(58) Field of Classification Search ..... 473/221, 473/198, 199, 209, 219, 220, 225, 236, 237, 473/257, 218, 217, 266, 270, 271, 273; 463/30
See application file for complete search history.

(56) References Cited

U.S. PATENT DOCUMENTS 4,451,043 A * 5/1984 Ogawa et al. ..... 473/225
4,630,829 A * 12/1986 White ..... 473/221
4,971,325 A * 11/1990 Lipps ..... 473/209
5,700,204 A * 12/1997 Teder ..... 473/199
5,718,639 A * 2/1998 Bouton ..... 473/151
6,227,984 B1 * 5/2001 Blankenship ..... 473/221
6,261,189 B1 * 7/2001 Saville et al. ..... 473/221
6,500,075 B1 * 12/2002 McDevitt ..... 473/272
6,821,211 B2 * 11/2004 Otten et al. ..... 473/219

* cited by examiner

*Primary Examiner*—Ronald Laneau
*Assistant Examiner*—Emmanuel Omotosho
(74) *Attorney, Agent, or Firm*—Dean A. Craine

(57) ABSTRACT

An electronic golf swing analyzing system that uses an array of infrared (IR) and ultrasonic (U/S) sensors, activated by an embedded micro-controller, to capture swing data to accurately calculate the club head's velocity, face angle, and swing path at impact. The system also includes a golf swing analyzing software application that receives the data from the analyzer to determine the distance and direction that the ball will travel relative to the target line. During use, the IR sensor base is placed horizontally and the U/S sensor base is positioned vertically. The player selects one of three available practice modes, which determines how the trajectory data for each swing is visually displayed. The player selects a golf club, enters golf ball information, and environmental conditions information. Trajectory results for each swing are graphically displayed relative to the players stated ability level on the computer monitor.

16 Claims, 9 Drawing Sheets

47
89
14
12
110
30
34
24
105

47
110
105

49
48
89
14
34
105
110

| CLUB | CLUB MFG / MODEL | HEAD WEIGHT(GR) | LOFT |
|---|---|---|---|
| Driver | TaylorMade Ti Bubble | 200 | 9.5° |
| 3 Wood | TaylorMade Ti Bubble | 210 | 13° |
| 3 Iron | Hogan GCD | 240 | 20° |
| 4 Iron | Hogan GCD | 247 | 23° |
| 5 Iron | Hogan GCD | 254 | 27° |
| 6 Iron | Hogan GCD | 261 | 31° |
| 7 Iron | Hogan GCD | 268 | 35° |
| 8 Iron | Hogan GCD | 275 | 39° |
| 9 Iron | Hogan GCD | 282 | 40° |
| Pitching Wedge | Hogan GCD | 289 | 48° |
| Gap Wedge | Hogan GCD | 292 | 52° |

ELECTRONIC GOLF SWING ANALYZING SYSTEM

This is a utility patent application which claims benefit of U.S. Provisional Application No. 60/398,041 filed on Jul. 23, 2002.

BACKGROUND OF THE INVENTION

1. Field of the Invention

This invention relates to improved electronic golf swing analyzers that use an opto-acoustical detection system to analyze a golfer's swing and, more particularly, to such analyzers that are portable and used with a personal computer.

2. Description of the Related Art

U.S. Pat. No. 4,630,829 discloses a compact, portable golf swing training and practice device that measures the speed and total swing time of a golf club during a swing. The device uses a light source and a photo detector that senses the movement of the golf club during the backswing and downswing. A computer is then used to perform calculations and transmit the information to a display or to a printer.

U.S. Pat. No. 5,718,639 discloses a video game sensing system mounted on a pad that uses infrared sensors and LEDs for detecting golf club parameter information by sensing light reflected off the golf club during the swing. The data is collected and transmitted to a microprocessor that determines the distance and path of the ball in the video game.

There are several drawbacks with the electronic golf swing analyzers found in the prior art. For example, to determine club head swing path angle, most analyzers use at least two separate arrays of multiple infrared sensors that are relatively expensive. Another drawback is that infrared sensors may be inaccurate or unusable in certain ambient light conditions.

SUMMARY OF THE INVENTION

It is an object of the present invention to provide a portable electronic golf swing analyzing system.

It is another object of the present invention to provide an electronic golf swing analyzing system that accurately measures during a golf swing the golf club head's velocity and face angle at impact with a golf ball, and the golf club head's swing path angle relative to the target line at impact.

It is a further object of the invention to provide an electronic golf swing analyzing system that combines the golf club head data collected by the infrared and ultrasonic sensors attached to an analyzer with selected golf club and golf ball specifications, current environmental conditions, and the player's physical profile inputted by the user to more accurately analyze the results of a particular user's golf swing.

These and other objects that may become apparent are met by an electronic golf swing analyzing system that includes a portable analyzer upon which a golf club is swung to measure the golf club head's velocity, face angle, and swing path angle. The analyzer is connected to a personal computer with a proprietary software application loaded into its working memory that calculates and graphically displays the predicted trajectory of the golf ball after each swing.

The analyzer uses a combination of infrared and ultrasonic sensors, which are activated by an embedded microcontroller, to collect club head data for each swing. The data is transmitted to a personal computer where the proprietary software program combines the swing data with other set up data supplied by the user to determine and graphically display the golf ball's predicted trajectory.

More specifically, the analyzer includes an infrared (IR) sensor base and a perpendicularly aligned ultrasonic (U/S) sensor base. In the preferred embodiment, the U/S sensor base is pivotally mounted on a support platform that is pivotally attached to the IR sensor base. Mounted under the top surface of the IR sensor base are two symmetrical arrays of infrared sensors used to measure the club head's velocity and face angle. Located on the U/S sensor base are two ultrasonic (U/S) sensors used to measure the club head's swing path angle. During use, the support platform is rotated upward along the rear edge of the IR sensor base so that the U/S sensors are perpendicularly aligned and aimed at the hitting area located on the IR sensor base.

In the preferred embodiment, two symmetrical arrays of sensors are equally spaced apart on opposite sides of a rubber tee located at the center of the hitting area. Each array consists of three photodiode detectors arranged in a triangular pattern centered over the target line and on opposite sides of the tee. The outer sensor in each array is position on the target line and the two inner sensors in each array are equally spaced apart above and below the target line. The two U/S sensors are spaced apart approximately six (6) inches and aligned with the outer photodiode detectors.

When the analyzer is activated and ready to capture swing data, an IR emitter adjacent to the outer photodiode detector begins to pulse infrared light. When a golf club travels over the pulsating outer IR emitter, light is reflected off the bottom surface of the club and causes the adjacent photodiode detector to produce current when pulsating IR light strikes the detector.

The current is converted into voltage, which activates a timer in the microprocessor that controls the sensors. This signal also activates the U/S sensor located on the same side of the activated IR sensor. Once the U/S sensor is activated and an echo is received, the other photodiode detectors in the array and the outer photodiode detector on the opposite array are activated in sequence. The second U/S sensor located above the opposite array of photodiode detectors and IR emitters on the outer photodiode detector on the opposite array detects the golf club. By measuring the length of time required for the golf club to travel between the outer photodiode detectors and the two inner photodiode detectors before impact, the club head's velocity and face angle at impact may be determined. By comparing the distance that the club head travels in front of each of the two U/S sensors, the swing path angle may be determined.

The software application provides three challenging and realistic practice modes: (1) hitting a golf ball relative to a target line; (2) hitting a golf ball relative to a target located at a selected distance; and (3) collecting average club distance information for the short game by hitting different wedges with varying lengths of backswings. Along with selecting a specific practice mode, the user selects a club to use, which automatically links the club head loft and the club head weight data for the selected club to the computer for making its trajectory calculations. The software also compensates for selected ball characteristics (compression and spin type), current environmental conditions (wind, barometric pressure, temperature and humidity) and the player's profile (left or right handed and ability level)

Another component of the analyzing system is an attached stance base upon which the player stands to swing the golf club. The stance base consists of two pivotally mounted platforms, each containing a gridded mat to provide visual reference lines parallel and perpendicular to the target line. The stance base connects to the IR sensor base at adjustable positions to allow the analyzing system to be used by players of different physical sizes, as well as left handed or right handed golfers.

DESCRIPTION OF THE PREFERRED EMBODIMENT(S)

Figure 1:
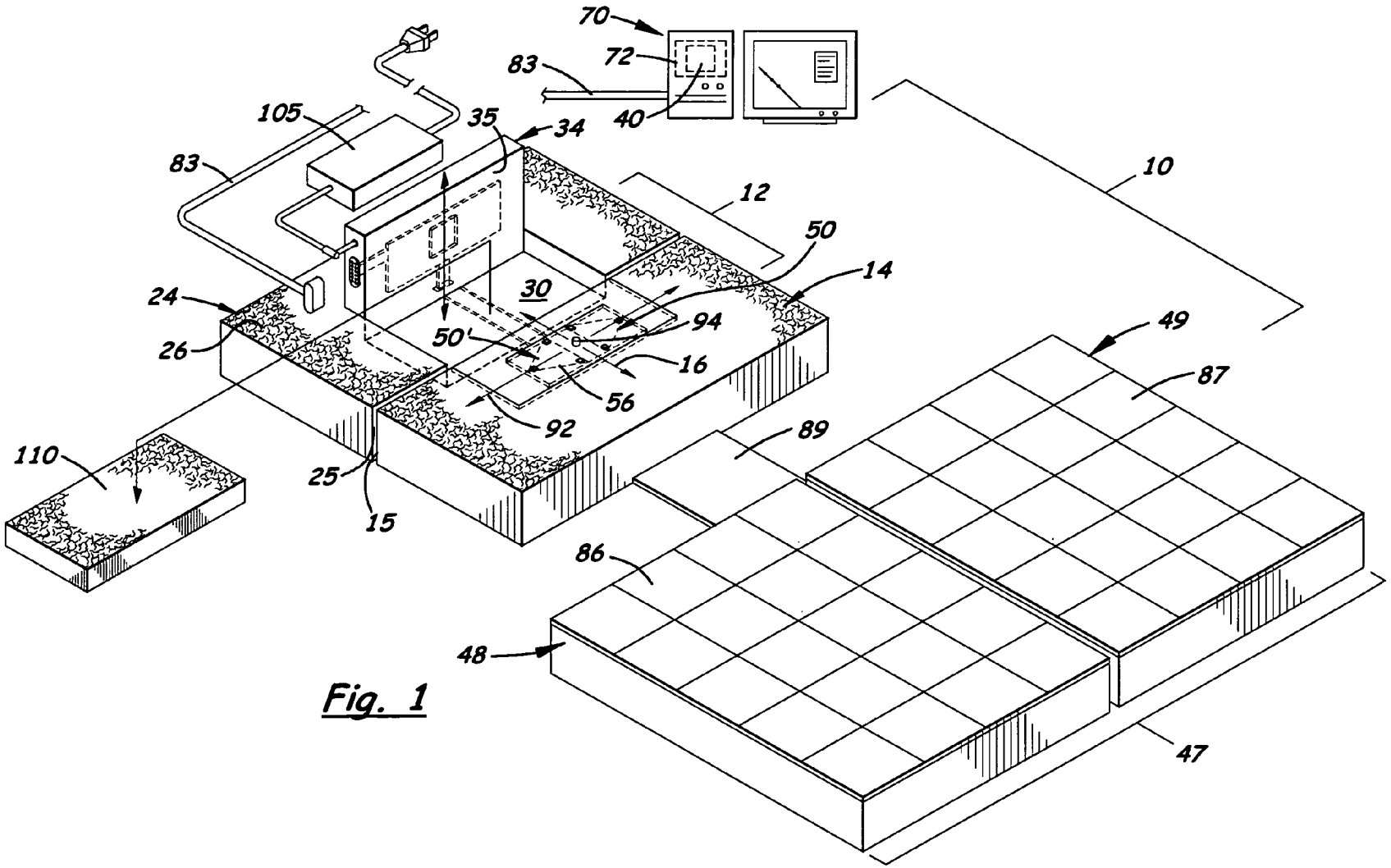
FIG. 1 is a perspective view of the electronic golf swing analyzing system.
Figure 2:
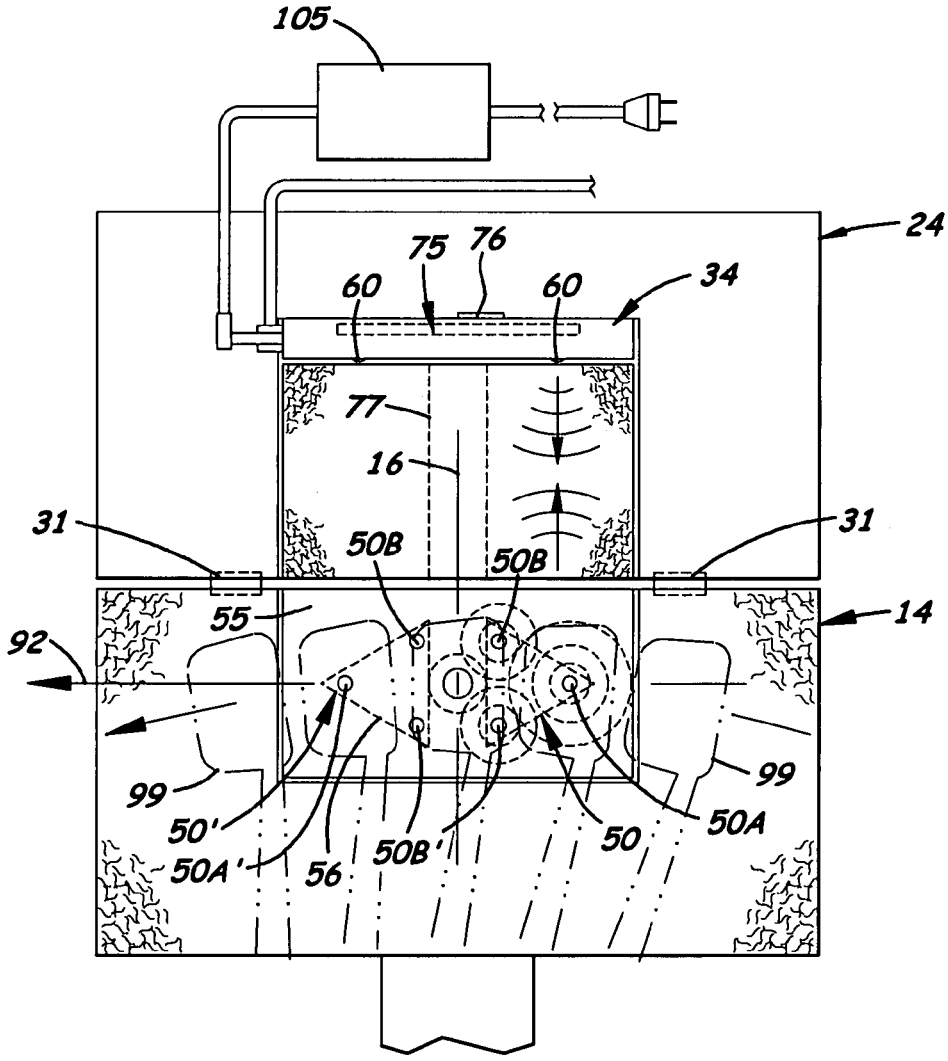
FIG. 2 is a top plan view of the analyzer.
Figure 3:
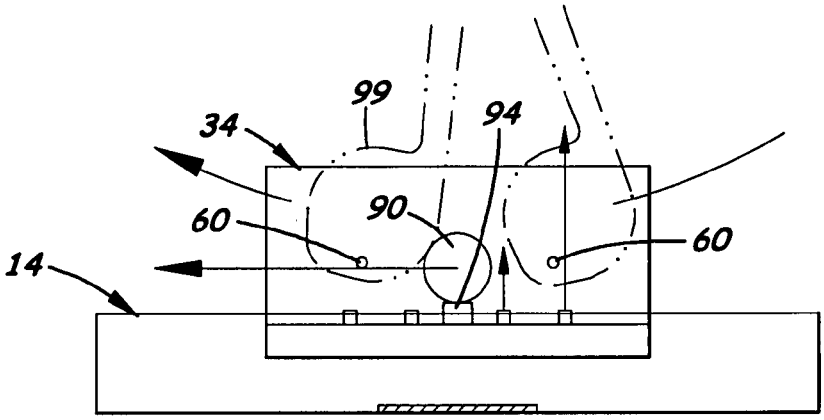
FIG. 3 is a front elevation view of the analyzer.

Referring to the accompanying Figures wherein like reference numbers refer to like components, there is shown an electronic golf swing analyzing system, generally indicated by reference number 10, that uses an analyzer 12 attached by a serial communications cable to a desktop or laptop computer 70 with a golf swing analyzing software application 40 loaded into the memory 72 of the computer 70. The software application 40 is designed to give the user immediate feedback information regarding the golf swing performed on the analyzer 12.

More specifically, the analyzer 12 includes an IR sensor base 14 and a support platform 24, pivotally connected together along their adjacent longitudinally aligned edges 15, 25, respectively, by hinges 31. The support platform 24 includes a U/S sensor base 34 that is rotated from a position inside a complementary-shaped storage cavity 30 formed on the support platform 24 to a rotated position, perpendicularly aligned to the top surface 26.

During use, the IR sensor base 14 and support platform 24, respectively, are unfolded onto a flat horizontally aligned position into a flat support surface. The U/S sensor base 34 is pivoted upward from the storage cavity 30 so that its bottom surface 35 faces a rectangular-shaped hitting area 20 located above the top surface 16 of the IR sensor base 14.

In the preferred embodiment, the IR sensor base 14 and the support platform 24 each measure approximately 20 inches in length, 10 inches in width and 1½ inches in thickness.

Figure 4:
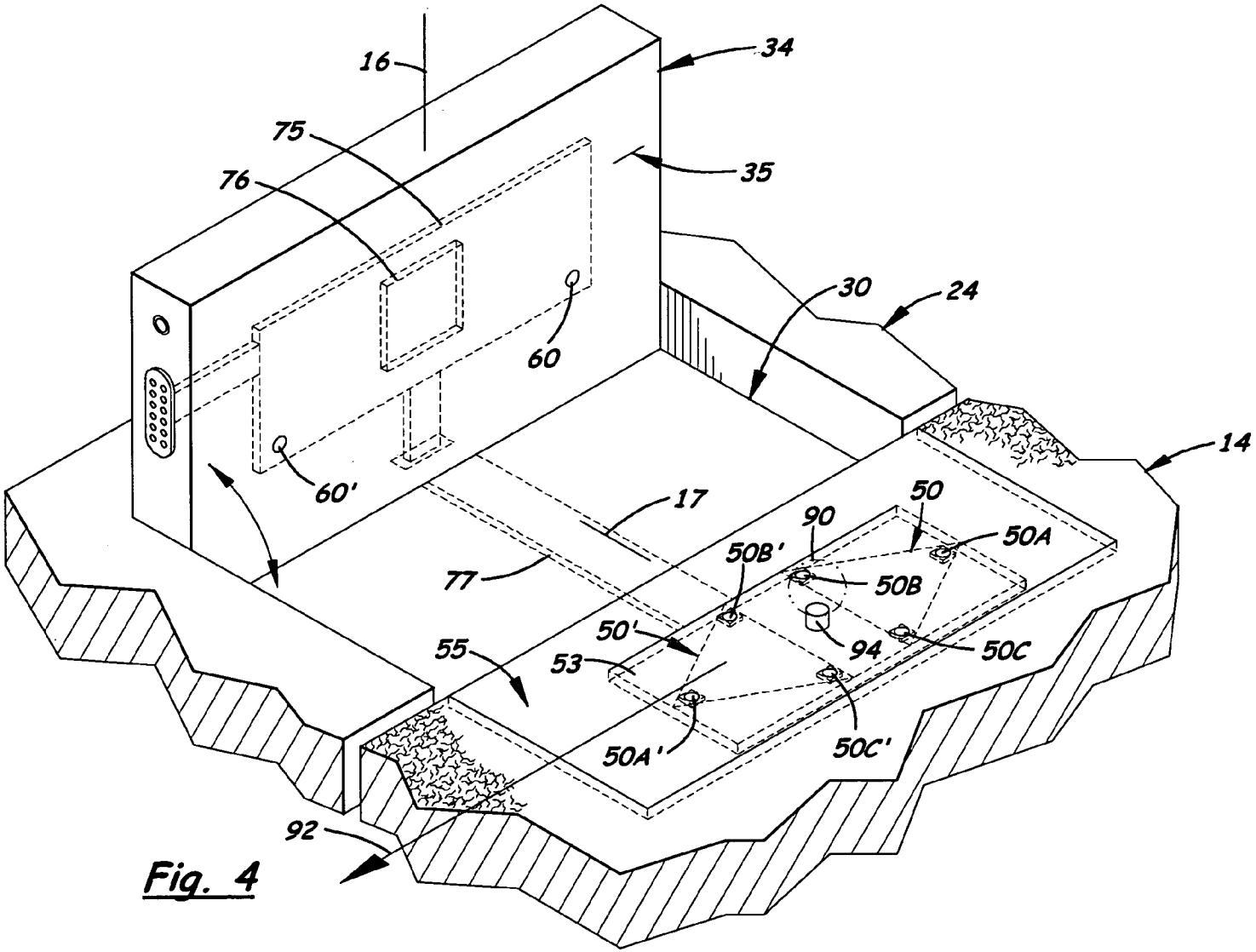
FIG. 4 is a partial perspective view of the analyzer showing the relative positions of the IR and U/S sensors.

The U/S sensor base 34 measures approximately 10 inches in length, 5 inches in width and 1 inch in thickness. Mounted on the IR sensor base 34 are two symmetrical, triangular-shaped arrays of (IR) infrared sensors, generally referenced as 50, 50' centered about the target line 92 and positioned right and left, respectively, of the center axis 17. The outer IR sensor 50A, 50A' on each array 50, 50', respectively, is positioned 3 inches left and right of the center axis 17. The two other sensor pairs in each array 50, 50', called inner IR sensors 50B, 50C, and 50B', 50C', respectively, are positioned 1 inch right and left, respectively, of the center of the golf ball 90 and about ¾ inches above and ¾ inches below the target line 92. As shown in FIG. 4, all of the IR sensors 50A, 50B, 50C, 50A', 50B' and 50C' are safely embedded below a rectangular shaped ¼ inch rubber pad 55 (5×10 inches in dimension), which is affixed with adhesive to the top surface of the IR sensor base 14 that covers the printed circuit board 53 on which the IR sensors 50A, 50B, 50C, 50A', 50B', and 50C' are mounted. Each IR sensor 50A, 50B, 50C, 50A', 50B', 50C', is aligned with a small (¾ inch diameter) hole 56 punched in the rubber pad 55 to allow transmission of infrared light. Because the two triangular arrays 50, 50' are symmetrically aligned on opposite sides of the center axis 17, the analyzer 12 may be used by both left- and right-handed golfers without requiring any mechanical change to the system 10.

As shown more clearly in FIG. 4, mounted on the bottom surface 35 of the U/S sensor base 34 are two U/S sensors, generally referenced as 60 and 60'. The U/S sensors 60, 60' are commonly referred to as transducers. Each U/S sensor 60, 60' functions in "pulse-echo mode," first as an ultrasonic transmitter, then, as an ultrasonic receiver. The U/S sensors 60, 60' are horizontally aligned with the bottom surface 35 of the sensor base 34 and parallel with the target line 92. The U/S sensors 60, 60' are axially aligned on opposite sides of the center axis 17 and aligned with the outer infrared sensors, 50A, 50A', respectively. In the preferred embodiment, the U/S sensors 60, 60' are positioned on the sensor base 34 so that when the sensor base 34 is rotated vertically, the U/S sensors 60, 60' are positioned approximately one and one-half (1-½) inches above the top surface of the IR sensor base 14.

Figure 5:
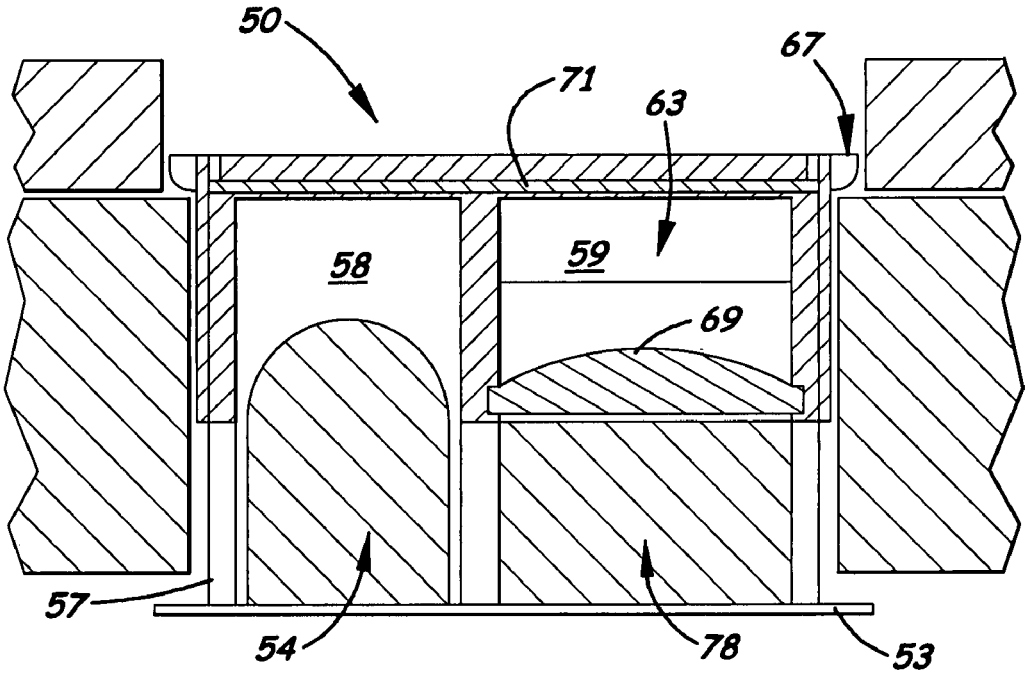
FIG. 5 is a side elevational view of an IR sensor mounted inside a bushing.
Figure 6:
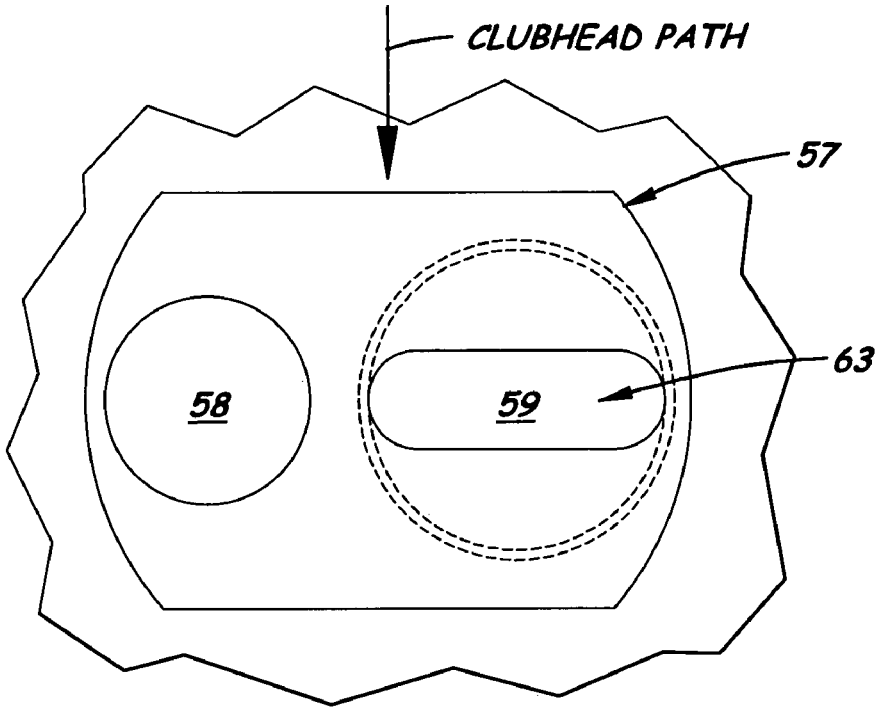
FIG. 6 is a top plan view of the IR sensor cap used with the IR sensor shown in FIG. 5.

As shown in FIGS. 5 and 6, each IR sensor denoted 50 includes an infrared emitter 54 and an adjacent infrared photodiode detector 78. In the preferred embodiment, the infrared emitter 54 is a high power light emitting diode (LED). The infrared photodiode detector 78 is a gallium aluminum arsenide (GaAlAs) photodiode. The infrared emitter 54 and photodiode detector 78 are spectrally matched pairs of infrared components that are reliable, easily controlled with a micro-controller and relatively inexpensive. The LED produces a narrow (5 degree) cone of IR light, focused vertically relative to its centerline. The LED is pulsed by a 25 KHz signal (5 uS on, 35 uS off) resulting in a 12.5% duty cycle. Pulsing the IR LED at a relatively low duty cycle significantly increases the current that can safely be applied to the LED, which substantially increases the range that the adjacent photodiode can "see" the club head by detecting reflected IR beam from the bottom of the club head as it passes over the two IR sensor arrays 50, 50.'

A sensor cap 57 is placed over each IR emitter 54 and adjacent photodiode detector 78. In the preferred embodiment, the cap 57 is injection molded and made of light blocking material, such as black ABS plastic. Formed within the cap 57 are two optically separated round cavities 58, 59 designed to receive the infrared emitter 54 and the photodiode detector 78, respectively. The infrared emitter 54 and photodiode detector 78 on the six IR sensors 50 are all mounted on a printed circuit board 53.

During assembly, the printed circuit board 53 is positioned inside the IR sensor base 14. The cap 57 rests on the printed circuit board 53 so each pair of infrared emitter 54 and photodiode detector 78 extends into the cavities 58 and 59. A cylindrical shaped bushing 67 is placed over each cap 57. Located over the photodiode detector 78 and inside the photodiode detector's cavity 59 is a convex lens 69. The lens 69 is injection molded from transparent polycarbonate and functions to gather any IR light that enters the cavity 59 through a narrow slot 63 formed on the top surface of the cap 57 and to direct the IR light towards the photodiode detector's active area. One additional component of each cap 57, is a ¾" round plastic IR bandpass filter, hereinafter called a IR filter 71, that permits only a narrow bandwidth of IR light to be transmitted through the IR filter 71 and into the cavity 59. During assembly, the IR filter 71 is placed on the top edge of each cap 57 and held securely in place by a small lip formed on the inside surface of the bushing 67.

The high frequency U/S sensors 60, 60' operate at a frequency of 200 KHz. Such components are reliable, easily controlled with a micro-controller and relatively inexpensive. When a pulsed high voltage signal is applied to the U/S sensor 60, 60', the transmitter produces a sonic wave with most of its energy focused within a fifteen (15) degree cone, 7.5 degrees left or right of the centerline of the U/S sensor 60, 60'.

As shown in FIG. 4, a flat ribbon cable 77 extends between the IR sensor base 14 and U/S sensor base 34 to connect the printed circuit board 53 for the infrared sensors 50A, 50B, 50C and 50A', 50B', 50C' to a printed circuit board 75, located in the U/S sensor base 34. A wireless or wired link, such as a serial cable 83 connects the micro-controller 76, located on the U/S sensor printed circuit board 75 to a computer 70. A 110-volt A.C. transformer 105 is provided for providing +/−12 DC volt and 5 volt DC power to the analyzer 12.

Figures 7A, 7B, 7C:
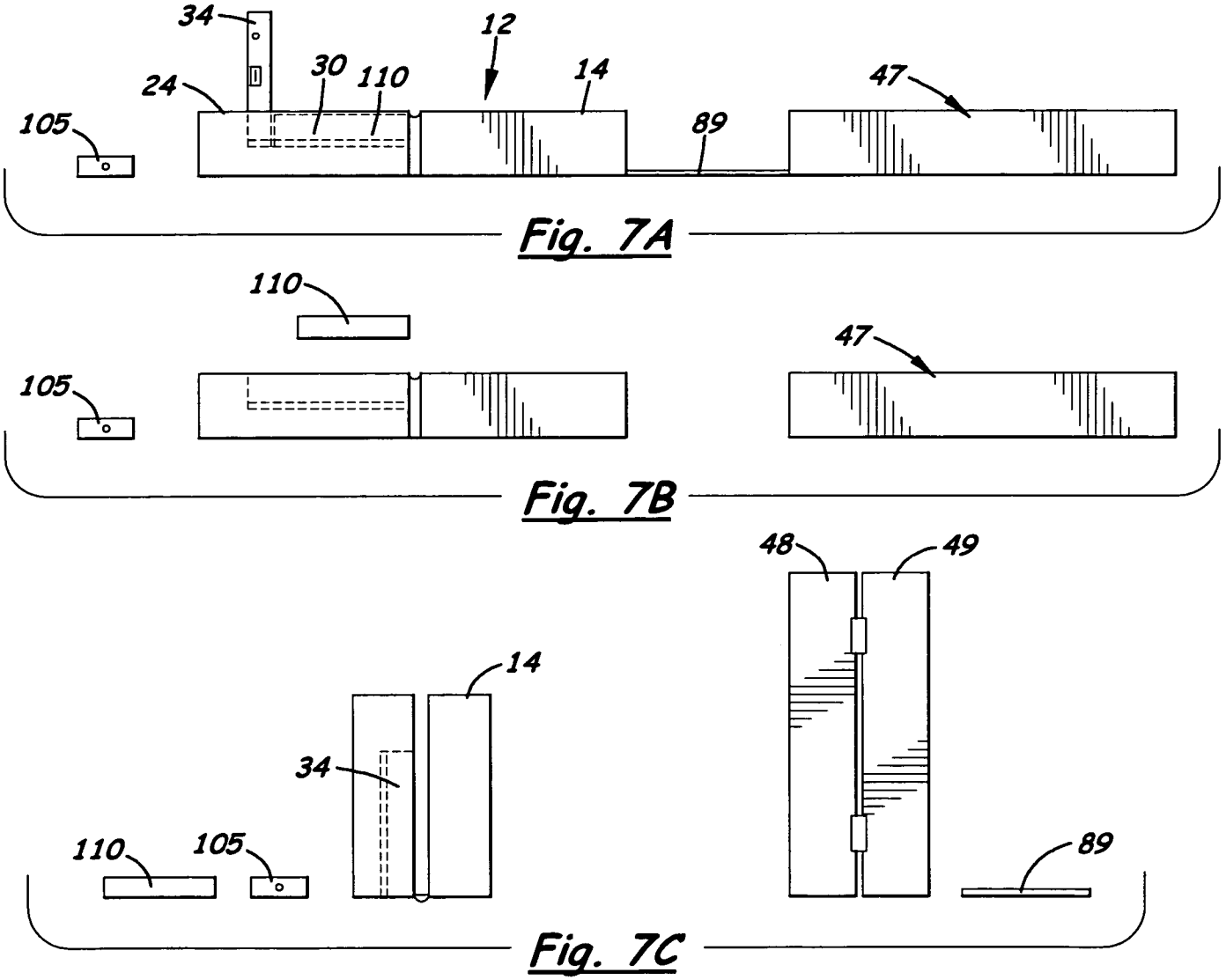
FIGS. 7A-C are illustrations showing the analyzer and stance base are folded into a compact configuration.

In the preferred embodiment, an optional artificial turf insert panel 110 is placed inside the cavity 30 during assembly to provide a continuous flat surface between the golf ball 90 and the U/S sensor base 34. During disassembly, the insert panel 110 is removed from the cavity 30 so that the U/S sensor base 34 may be folded into the cavity 30, as shown in FIGS. 7A-7C.

In the preferred embodiment, an optional stance base 47 is also provided that includes two hinged boxes 48, 49, each about sixteen inches (16") by twenty inches (20") in dimension and about one and one-half inches (1½") high. The boxes 48, 49 form a structure approximately twenty inches (20") by thirty-two inches (32") upon which the player stands to swing the golf club. Each box 48, 49 includes a gridded mat, 86, 87, respectively, that provides visual reference lines parallel and perpendicular to the target line 92. The stance base 47 is physically connected by a connector bridge 89 to the IR sensor base 14. The bridge 89 is adjustable left and right, as well as in and out, relative to the analyzer 12 to accommodate players of different physical sizes, as well as left handed or right handed golfers.

The software application 40 provides three practice modes: (1) hitting a golf ball relative to a target line; (2) hitting a golf ball relative to a target located at a selected distance; and (3) collecting the average distance data for the short game by hitting different wedges with varying lengths of backswings. Along with selecting a specific practice mode, the user selects a club to use, which automatically links related club head loft and club head weight data to the computer 70 for making its trajectory calculations. The software application 40 also compensates for selected ball characteristics (compression and spin type), current environmental conditions (wind, barometric pressure, temperature and humidity) and the player's profile (left or right handed and ability level).

Theory of Operation

Club head velocity is a measure of how fast the club head 99 is moving at impact with the ball, which, along with the mass of the club head 99, determines how much energy is available to be transferred to the golf ball 90. Club face angle is a measure of whether the clubface is square, open or closed relative to the target line 92 at impact. Swing path angle is a measure of whether the club head 99 is traveling directly down the target line 92 or being pulled or pushed across the target line 92 at impact. By determining these three data, the distance that the golf ball 90 will travel, and the flight path of the ball relative to the target line 92 after impact may be accurately calculated.

When a player swings a golf club to hit a golf ball positioned on a rubber tee 94 on the rubber pad 5 of the IR support base 14, the club head 99 passes over the outer IR sensor 50 or 50'. IR light emitted from the IR emitter on the outer IR sensor 50A is reflected from the bottom of the club head 99 to the adjacent photodiode detector 78. This reflected IR signal, when it is detected, starts a timer 76 in the micro-controller and triggers a burst of twenty (20) cycles of 200 KHz sonic energy from the U/S sensor 60, 60' aligned with the array 50. The sonic waves quickly reach the club head 99 and are reflected back to the U/S sensor 60, 60'. The micro-controller 76 is programmed to read the timer when the first echo above a set threshold voltage is detected. When the first ultrasonic echo is captured, the micro-controller 76 is programmed to start pulsing IR light from both of the inner IR sensors 50B, 50C in the array 50. The micro-controller 76 remains in a tight loop, waiting for each of the two inner sensors 50B, 50C to automatically capture the micro-controller timer reading when the IR photodiode detectors "see" the club head 99 and set a data flag to indicate that the time has been captured. When both data flags are set, the micro-controller 76 stops the timer, stops pulsing the IR sensors 50B, 50C and exits the loop.

The two inner IR sensors 50B', 50C' on the other array 50' are not used if the golfer is right handed. The micro-controller 76 resets the timer and starts pulsing IR from outer IR sensor 50A' on the other array 50' until its photodiode detector 78 "sees" the club head 99. The reflected signal from the outer IR sensor 50A' restarts the timer in the micro-controller 76 and triggers a burst of twenty (20) cycles of 200 KHz sonic energy from the second ultrasonic transmitter 61'. The sonic waves quickly reach the club head 99 and are reflected back to the ultrasonic sensor 60; the micro-controller 76 stops the timer when the first echo above a set threshold voltage is detected.

At this point, the micro-controller 76 has captured all the required data, which are then transmitted from the micro-controller 76 to the computer 70 for processing by the software application 40.

From a simple physics formula, average velocity equals distance divided by time (v=d/t). With each array 50, 50', the distance (d) between the outer IR sensors 50A, 50A' and the inner IR sensors 50B, 50B', 50C, 50C', respectively, is two (2) inches. If the club head 99 is perpendicular ("square") to the target line 92, both the inner IR sensors 50B, 50B' and 50C, 50C' should "see" the club head 99 at the same time. If the club head 99 is open or closed, then the times that 50B, 50B' (Time2) and 50C, 50C' (Time3) will "see" the club head 99 will be slightly different. The software application 40 calculates the average time (Tavg) by adding T1+T2 and dividing the result by 2 (Tavg=[T1+T2)/2]). Average club head velocity (Vc) is calculated from the velocity formula as Vc=2.0/Tavg, which can be easily resolved to within one mile per hour.

If T1 and T2 are equal, then club face angle is 0; the club head at impact is perpendicular (square) to the target line. If the times are not equal, then determining club face angle requires two calculations. If T1 and T2 are not the same, then a small triangle is formed with one leg (D1) equal to the distance between IR2 and IR3, which is 1.5 inches. The length of the second leg of the triangle (D2) is formed by knowing the average velocity of the club head 99 (Vc) and the difference in time between T1 and T2 (T2−T1). From simple physics, D2=Vc*(T2−T1). The hypotenuse of this small triangle forms an angle that represents club face angle, which is calculated as the arc tangent of D2/1.5. The analyzer 12 will resolve club face angle to within one degree.

Determining club head 99 swing path angle also requires two calculations. First, the distance that the club head 99 passes in front of each U/S sensor 60, 60' is calculated. The speed of sound in air (Vs) is well documented and is primarily a function of ambient air temperature. The micro-controller timer captures the elapsed times required (T1 and T2) for sonic energy to leave each U/S sensor 60, 60', reflect from the club head 99, and be detected as an echo by the same U/S sensor 60, 60'. The distance (D1 or D2), therefore, is calculated as one-half of the product of Vs×(T1 or T2), since T1 and T2 represent times for the sonic energy to travel out and back to the U/S sensors 60, 60'. Swing Path Angle is calculated by comparing D1 and D2. If the distances are equal, the Swing Path Angle is 0, which means that the club head 99 is traveling parallel to the target line 92 at impact. If D1 and D2 are not equal, then a small triangle is formed. One leg of the triangle is the horizontal distance (Dh) between the U/S sensors 60, 60' (6 inches). The short vertical leg of the triangle (Dv) is the difference between D1 and D2 (Dv=D1−D2). The hypotenuse of this small triangle forms an angle that represents club swing path angle, which is calculated as the arc tangent of Dv/6. The analyzer will resolve club swing path angle to one degree.

Club head swing data is collected and transmitted to the user's computer 70 for further processing by the software application 40. The software application 40 makes several assumptions to calculate trajectory information. First, the software application 40 assumes that the initial ball velocity at impact is a function of available club head 99 energy and the golf ball 90 coefficient of restitution.

Second, the software application 40 assumes that the club head 99 loft at impact is equivalent to the club head 99 manufactured loft.

Also, for trajectory calculations, the software application 40 uses a nominal ball spin rate based on the type of golf ball 90, the club head 99 loft, and the golf ball 90 instantaneous velocity to determine a coefficient of lift and a coefficient of drag for its aerodynamic calculations The software application 40 does not determine golf ball 90 roll on the ground; distance measurements are carry distance of the golf ball 90 in the air.

Figure 8:
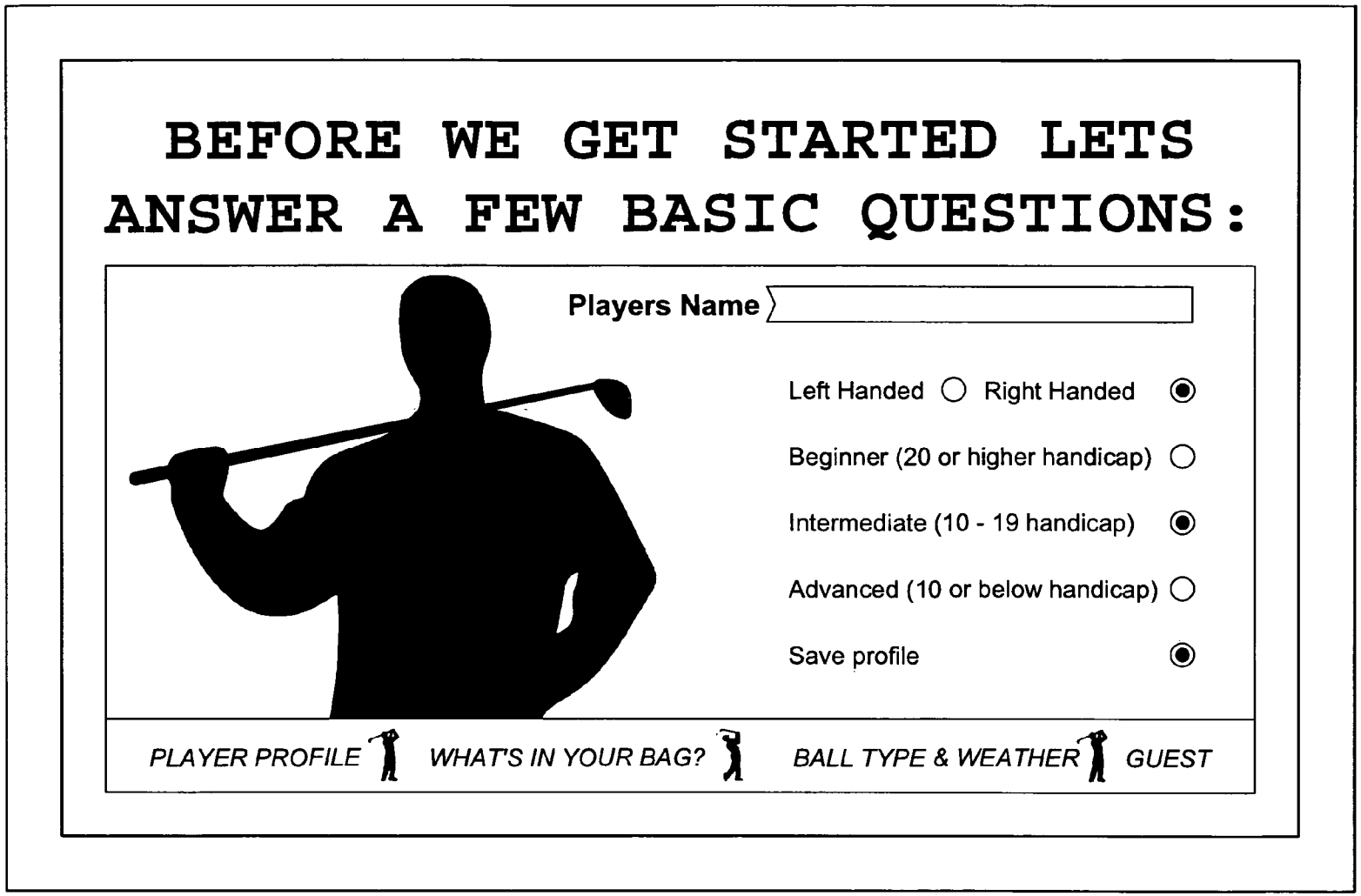
FIG. 8 is an illustration of the display screen created by the software program and used to input the user's personal information into the computer.
Figure 9:
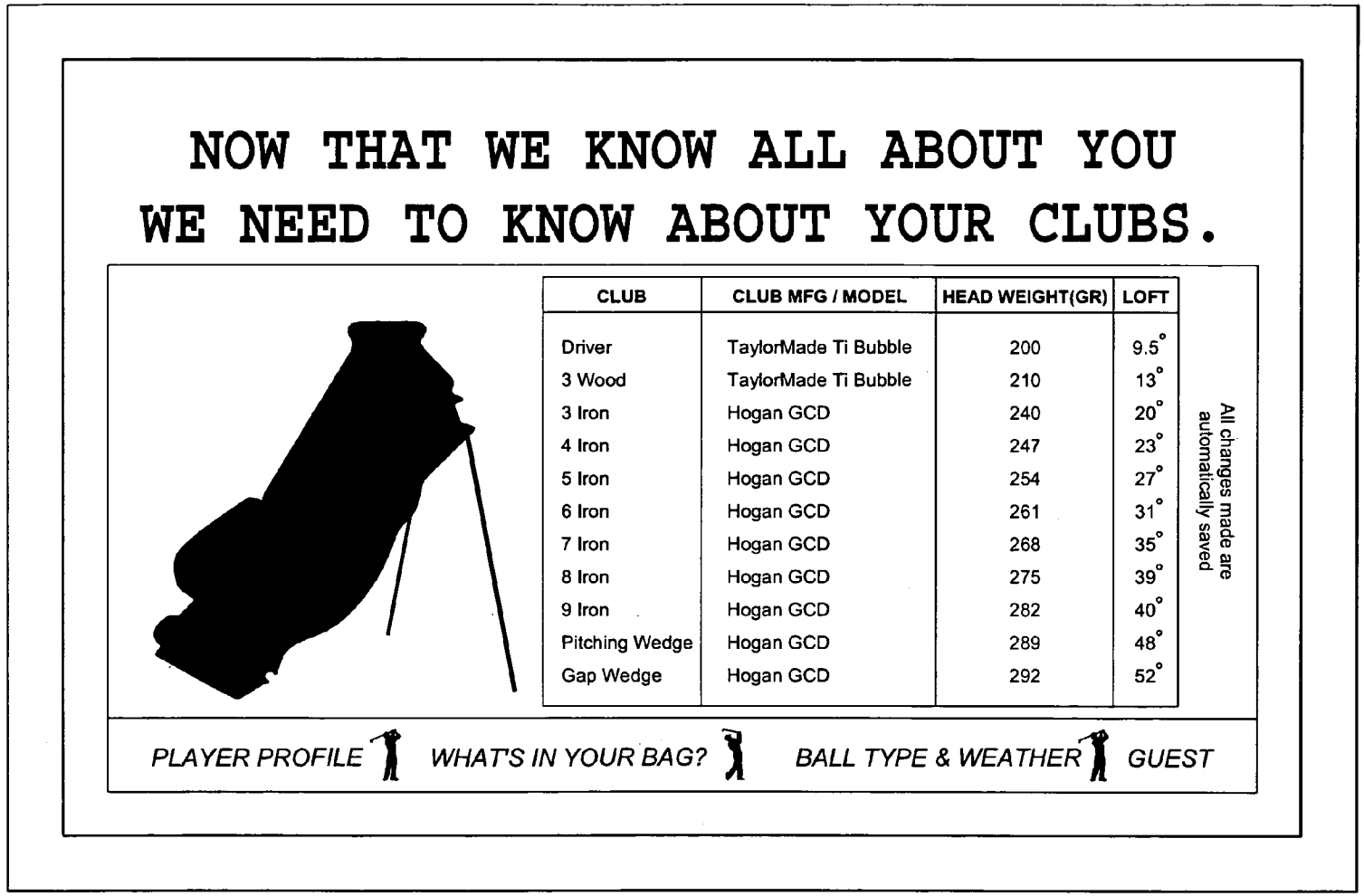
FIG. 9 is an illustration of the display screen used to input specifications for the player's golf clubs.
Figure 10:
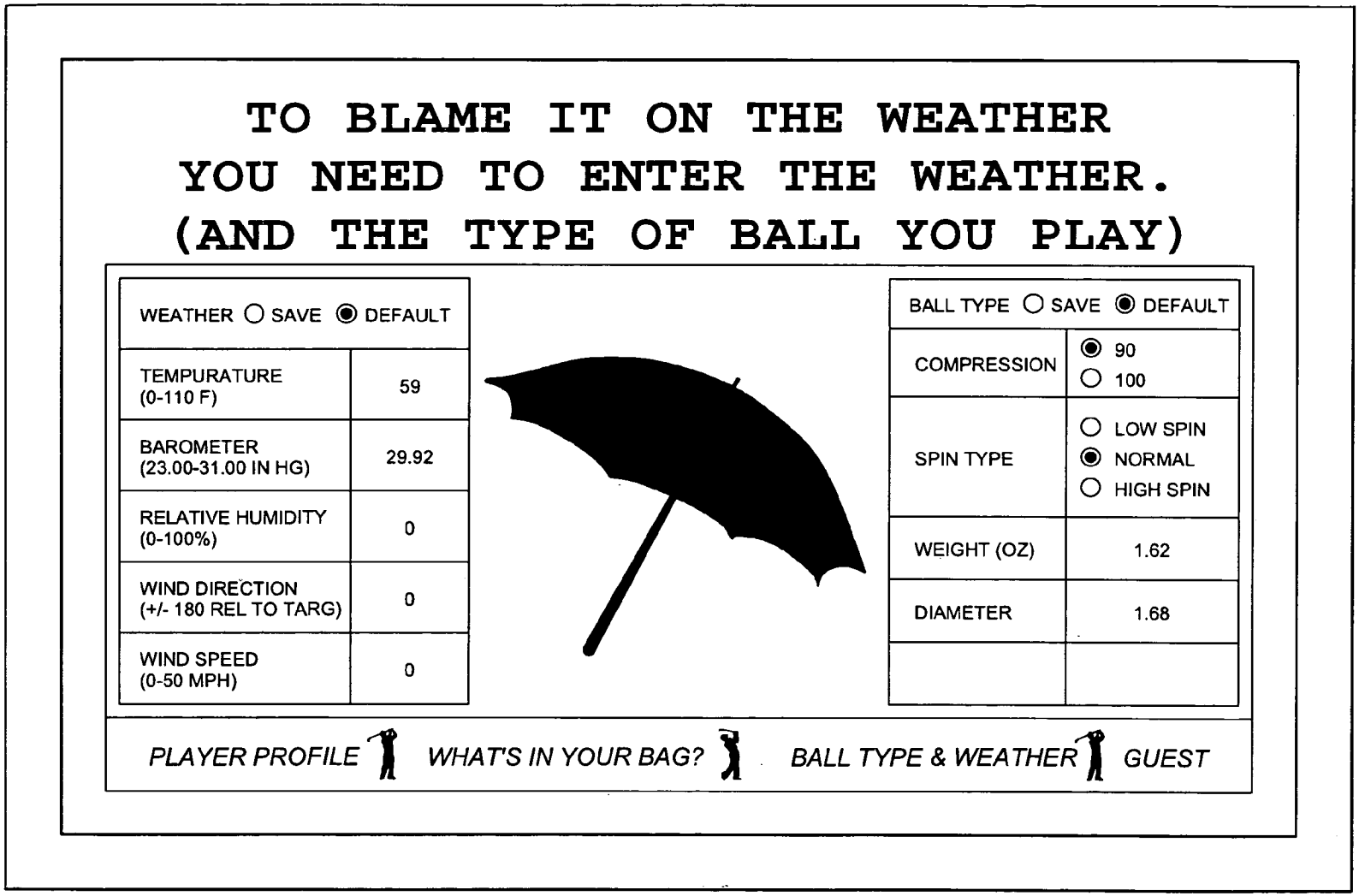
FIG. 10 is an illustration of the display screen used to input environmental conditions and golf ball information.
Figure 11:
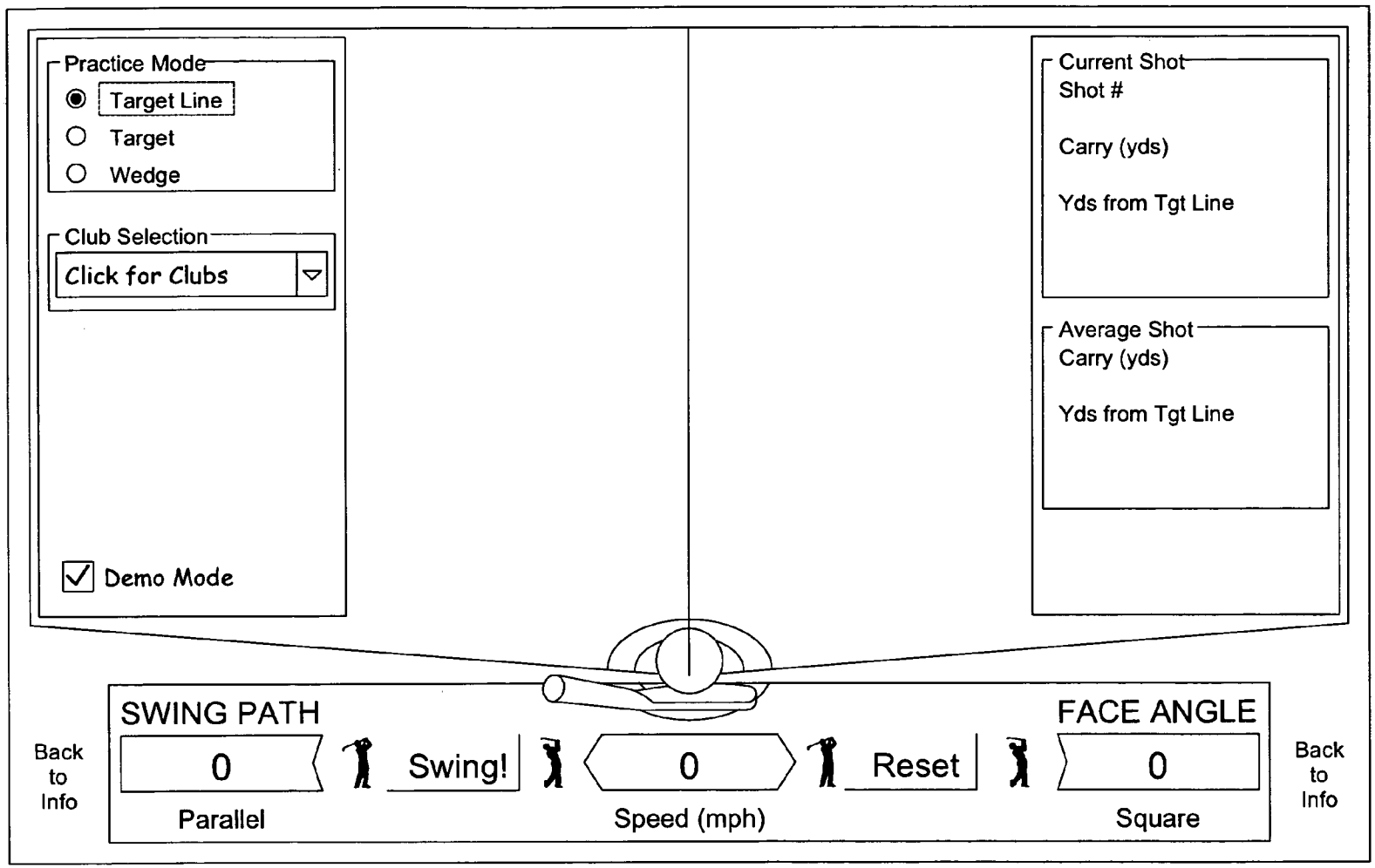
FIG. 11 is an illustration of the display screen used to graphically display trajectory results for the shot.

During use, the software program 40 presents an input page shown in FIG. 8 used to input the user's personal information into the computer. The software program 40 presents an input page shown in FIG. 9 used to input specifications for the player's golf clubs and environmental condition information shown in FIG. 10. Once the swing data has been collected and analyzed by the program 40, the software program 40 then presents the trajectory information on the display as shown on FIG. 11.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An electronic golf swing analyzer system, comprising:

a. an analyzer including an infrared sensor base and an ultrasonic sensor base, said infrared sensor base includes a hitting area with a center axis with two arrays of infrared sensors located therein used to detect the presence of a golf club head moving through said hitting area, each said array of infrared sensors being located on opposite sides and equal distance from said center axis, said ultrasonic sensor base being perpendicularly aligned and extending upward above said infrared sensor base, said ultrasonic sensor base including at least two ultrasonic sensors aimed at said hitting area, said ultrasonic sensors being located on opposite sides and equal distance from said center axis and approximately six inches apart, said array of infrared sensors and said ultrasonic sensors being controlled so that when a golf club head moves across said hitting area on said infrared sensor base and parallel to said ultrasonic base, said array of infrared sensors located in front of said center axis being activated when said golf club head moves through said hitting area and which then sequentially activates said ultrasonic sensor on the same side of said center axis and said array of infrared sensors and said ultrasonic sensor located on the opposite side of said center axis;

b. a computer having working memory;

c. means for connecting said analyzer to said computer; and, d. a golf swing analyzing software application loaded into said working memory of said computer, said software application uses the data from infrared sensors located before said center line axis when said golf club head moves through said hitting area to determine the club head's speed and face angle, said software application also uses the data from said two ultrasonic sensors as said travels through said hitting area to determine the swing path angle.

2. The electronic golf swing analyzer system, as recited in claim 1, wherein said arrays of infrared sensors are symmetrical and include one outer infrared sensor and two inner infrared sensors.

3. The electronic golf swing analyzer system, as recited in claim 2, wherein each said infrared sensor includes a pulsing infrared emitter and an infrared photodiode detector.

4. The electronic golf swing analyzer system, as recited in claim 3, wherein said infrared emitter and said infrared photodiode detector are located in a bushing fitted to said infrared support base.

5. The electronic golf swing analyzer system, as recited in claim 4, further including an infrared filter located over said photodiode detector.

6. The electronic golf swing analyzer system, as recited in claim 5, further including a lens mounted over said photodiode detector to direct infrared radiation towards said photo-detector.

7. The electronic golf swing analyzer system, as recited in claim 1, further including a rubber mat attached over said infrared sensor base.

8. The electronic golf swing analyzer system, as recited in claim 1, wherein said means to connect said computer to said analyzer is a serial communications cable.

9. The electronic golf swing analyzer system, as recited in claim 1, wherein said infrared support base and said ultrasonic support base are pivotally connected together along one edge thereby enabling said analyzer to be selectively opened and closed.

10. The electronic golf swing analyzer system, as recited in claim 1, wherein said ultrasonic sensors are automatically software activated at the proper time to produce ultrasonic signals when a golf club moves over said arrays of infrared sensors located on the same side of said center axis of said infrared support base, said ultrasonic sensors being aimed to transmit an ultrasonic signal and receive a reflected ultrasonic signal from a golf club moving over said array of infrared sensors located on the same side of said center axis.

11. An electronic golf swing analyzer system, comprising:

a. an analyzer including an infrared sensor base and an ultrasonic sensor base, said infrared sensor base includes a hitting area with a center axis with two arrays of infrared sensors located therein used to detect the presence of a club head moving through said hitting area, each said infrared sensor in each said array of pulsing infrared sensors includes an infrared emitter and an infrared photodiode detector mounted on opposite sides and equal distance from said center axis, said ultrasonic sensor base being perpendicularly aligned and extending upward above said infrared sensor base, said ultrasonic sensor base including at least two ultrasonic sensors aimed at said hitting area, said ultrasonic sensors being located on opposite sides and equal distance from said center axis and approximately six inches apart, said ultrasonic sensors being activated to produce ultrasonic signals when a golf club moves over said array of infrared sensors located on the same side of said center axis, said ultrasonic sensors being aimed to transmit an ultrasonic signal and receive a reflected ultrasonic signal from a golf club moving over said array of infrared sensors located on the same side of said center axis;

b. a computer having working memory and a visual display means;

c. means for connecting said analyzer to said computer; and, d. a golf swing analyzing software application loaded into said working memory of said computer, said software application uses the data from said ultrasonic sensors to calculate the swing path angle and uses the data from said arrays of infrared sensors to determine the club head velocity and face angle at impact when a golf club is swung over said hitting area and impacts a golf ball located on said center axis.

12. The electronic golf swing analyzer system, as recited in claim 11, wherein said infrared support base and said ultrasonic support base are pivotally connected together along one edge thereby enabling said analyzer to be selectively opened and closed.

13. The electronic golf swing analyzer system, as recited in claim 11, further including a stance base connected to said infrared support base upon which a player stands to swing a golf club.

14. The electronic golf swing analyzer system, as recited in claim 13, wherein said stance base includes a grid surface.

15. The electronic golf swing analyzer system as recited in claim 14, wherein said stance base includes two hinged boxes.

16. The electronic golf swing analyzer system, as recited in claim 11, wherein said software program allows a user to select a specific club, ball, environmental conditions, and the player's profile (right handed or left handed golfer).

* * * * *